US005139233A

United States Patent [19]

Goss

[11] Patent Number: 5,139,233

[45] Date of Patent: Aug. 18, 1992

[54] TRANSMISSION JACK ADAPTOR

[76] Inventor: Arthur Goss, 46 Shore Rd., Wellesley, Mass. 02181

[21] Appl. No.: 693,447

[22] Filed: Apr. 29, 1991

[51] Int. Cl.[5] ..... B25B 11/00; B66F 7/26

[52] U.S. Cl. ..... 254/134; 269/17; 254/DIG. 16

[58] Field of Search ..... 254/133 R, 134, DIG. 4, 254/DIG. 16; 269/17, 296

[56] References Cited

U.S. PATENT DOCUMENTS

| | | | |
|---|---|---|---|
| 399,926 | 3/1889 | Pollard | 254/134 |
| 1,283,795 | 11/1918 | Kelley | 254/134 |
| 1,363,020 | 12/1920 | Shewalter | 269/17 |
| 1,918,591 | 7/1933 | Dart | 254/134 |
| 2,747,837 | 5/1956 | Turner | 254/134 |
| 2,748,459 | 6/1956 | Orr | 269/296 |
| 2,838,278 | 6/1958 | Johnsen | 254/134 |
| 3,062,500 | 11/1962 | Arnes et al. | 254/7 |
| 3,136,526 | 6/1964 | Wolf | 254/10 |
| 3,559,981 | 2/1971 | Abshear | 254/134 |
| 3,628,772 | 12/1971 | Gaarder | 254/134 |
| 3,773,293 | 11/1973 | Arnes | 254/134 |
| 4,239,196 | 12/1980 | Hanger | 269/17 |
| 4,269,394 | 5/1981 | Gray | 254/134 |
| 4,445,667 | 5/1984 | Webb | 254/134 |
| 4,549,722 | 10/1985 | Gagliano | 254/134 |
| 4,570,905 | 2/1986 | Gerstner | 254/134 |
| 4,787,600 | 11/1988 | Bode | 254/126 |
| 4,796,861 | 1/1989 | Petty | 254/8 B |

OTHER PUBLICATIONS

Photo and description of E40D Transmission Adapter, model no. 014-00763, from "Equipment of the 1990's" Rotunda Equipment Catalog, p. F33.

*Primary Examiner*—J. J. Hartman

*Attorney, Agent, or Firm*—Cesari and McKenna

[57] ABSTRACT

A lift jack adaptor for cradling a heavy irregularly shaped object such as an automotive transmission includes a rigid base for mounting to a lift jack and pairs of laterally spaced arms extending up from the base, the upper ends of those arms being terminated by flanges for engaging the underside of the object cradled in the adaptor. These flanges are fastened to the object and positively connect the object to the adaptor so that one can raise and lower the object using the jack and repair the object in relative safety.

11 Claims, 3 Drawing Sheets

TRANSMISSION JACK ADAPTOR

This invention relates to a lift jack adaptor for supporting an irregularly-shaped work piece. It relates more particularly to a lift jack adaptor for supporting and cradling an automotive transmission while removing the transmission from or replacing it in a vehicle.

BACKGROUND OF THE INVENTION

A transmission is the link in the automotive drive train which conducts torque from the engine to the differential that drives the wheels on most vehicles. During the useful life of the vehicle, the transmission may malfunction due to a clogged fluid pathway, a broken rotor, a stripped gear or for some other reason, necessitating repair of the transmission. Most automotive transmissions have access openings at the undersides of their housings. These openings are normally covered by pans or covers bolted to the undersides of the transmission housings. Once a vehicle is raised from the floor on a hydraulic lift, a mechanic standing under the vehicle can remove the pan and inspect the interior of the transmission.

However, as a practical matter, major repairs to the transmission cannot be made via that inspection opening. Rather, to effect such repairs, the transmission must be decoupled from the remainder of the drive train and brought down to floor level where it can be disassembled. In the meantime, a replacement transmission may be installed in the vehicle to minimize the downtime of the vehicle.

Due to its weight, which can be 250 pounds or more, the typical transmission has to be supported mechanically during its removal and replacement. Usually, such support is provided by a lift jack which is a tool having a base which rests on the floor and a platform which can be raised relative to the base by means of a hydraulic piston, lead screw or the like. After the vehicle is raised above the floor, the jack can be positioned under the vehicle and the jack's lift platform raised so that the platform engages under the transmission. With the jack supporting the weight of the transmission, the transmission can be disconnected relatively easily from the engine, lowered and wheeled from under the vehicle. That procedure is reversed when a replacement transmission is being installed in the vehicle.

In order to prevent the transmission from falling off the jack, usually some means are provided for securing the transmission to the jack's lift platform. In the past, such means have included chains wrapped around the transmission and secured to the platform and various brackets and adaptors mounted to the platform for cradling the transmission. Examples of such adaptors are shown in U.S. Pat. Nos. 2,838,278; 3,136,526; 4,549,722 and 4,787,600. Such adaptors work reasonably well with older transmissions because the undersides of those transmissions are fairly flat and regular. That is, an older transmission has a flat area around the access opening into the transmission housing. The pan which covers that opening is also flat, generally rectangular and relatively shallow, e.g. 2 inches deep. The pan, which has a peripheral flange bolted to the housing, thus forms a flat pedestal upon which the transmission may stand in reasonably good balance. For this reason, it is relatively easy to support an old-style transmission using a conventional jack fitted with transmission adaptors of the types shown in the above patents.

In the last few years, however, the shapes of many transmissions have changed drastically due to the increased complexity of those mechanisms. This is particularly true in the case of the heavier transmissions used in trucks. These newer transmissions do not have flat areas at the undersides of the transmission housings. On the contrary, the housing undersides are rounded and the pans which cover the access openings into the transmissions are made of relatively thin gauge metal and they are deeply dished, extending 5 inches or more below the transmission housing, so that they cannot bear the weight of, or stably support, the transmissions.

For the same reasons, conventional lift jacks and the transmission adaptors therefor are not able to cradle the newer transmissions in a stable and secure fashion because they are not shaped and arranged to accommodate the pronounced curves and bulges present at the undersides of the transmissions or the unbalanced weight distributions of the transmissions. As a result, great care must be taken to make sure that a transmission does not fall off the lift jack or unbalance the jack to such an extent that the jack tips over. This requirement for extra care slows down the transmission removal and replacement process and thus increases the overall cost of transmission repair. Also, since the transmissions are not supported as stably and securely as they should be, there is an increased risk of injury to the mechanic working on the transmission.

SUMMARY OF THE INVENTION

Accordingly, the present invention aims to provide a lift jack adaptor that can cradle a heavy irregularly shaped object such as an automotive transmission.

Another object of the invention is to provide an adaptor of this type which can support in a stable manner automotive transmissions having uneven weight distributions.

Still another object of the invention is to provide a transmission lift jack adaptor which can be used in conjunction with a variety of different lift jacks.

Yet another object of the invention is to provide an adaptor of this general type which can be accommodated to automotive transmissions having different sizes and/or shapes.

Other objects will, in part, be obvious and will, in part, appear hereinafter.

The invention accordingly comprises the features of construction, combination of elements and arrangement of parts which will be exemplified in the construction hereinafter set forth, and the scope of the invention will be indicated in the claims.

Briefly, my adaptor comprises a rigid base having means enabling the adaptor to be secured to the lift platform of a conventional lift jack of the type normally used in connection with transmission replacement. The securement means may be variously placed on the base to register with fasteners on the platforms of the standard lift jacks. At least two pairs of laterally spaced apart arms extend up from the base parallel to one another. Preferably the arms are vertical and they are terminated at their upper ends by flanges, the upper faces of which define a plane which is elevated an appreciable distance above, and is more or less parallel to, the base. The spacing of the arms and the dimensions of the flanges are such that when the adaptor is positioned under an automotive transmission in the area of the dished transmission pan, the flanges may engage opposite sides of the pan that is normally bolted to the underside of the transmission housing, with the pan projecting down between the arms of the adaptor. Resultantly, the adaptor is able to cradle the transmission in a secure and stable fashion without any load being imparted to the dished portion of the pan.

Preferably, apertures are provided in the flanges which are arranged to register with bolts that secure the transmission pan to the transmission housing. Prior to engaging the adaptor against the underside of the transmission, those bolts may be removed. Then, after registering the flange apertures to the bolt holes in the transmission housing, those bolts can be replaced to secure the adaptor positively to the underside of the transmission. There being a firm connected between the transmission and the adapter, there is no possibility of the transmission falling from the lift jack as the transmission is being lowered, raised or moved about.

As will be seen presently, the arms of the adaptor may have fixed spacings and dimensions suited to a particular size transmission. Alternatively, the arms can be releasably mounted to the base so that their spacings may be adjusted to suite transmissions having various shapes and sizes. Likewise, the arms themselves can be extensible so that their lengths can be adjusted to accommodate transmissions whose pans extend to different depths.

My adaptor is a very useful tool to have in a garage or other repair facility at which transmission removal and replacement is carried out on a day-to-day basis. The adaptor facilitates removal and replacement of the transmission in a speedy, yet secure, manner. Therefore, it should reduce the time and cost of transmission repair. Yet, the tool is relatively easy and inexpensive to make. Therefore, it should be available to even the smaller repair facilities.

BRIEF DESCRIPTION OF THE DRAWINGS

For a fuller understanding of the nature and objects of the invention, reference should be had to the following detailed description, taken in connection with the accompanying drawings, in which.

DESCRIPTION OF THE PREFERRED EMBODIMENTS

Figure 1:
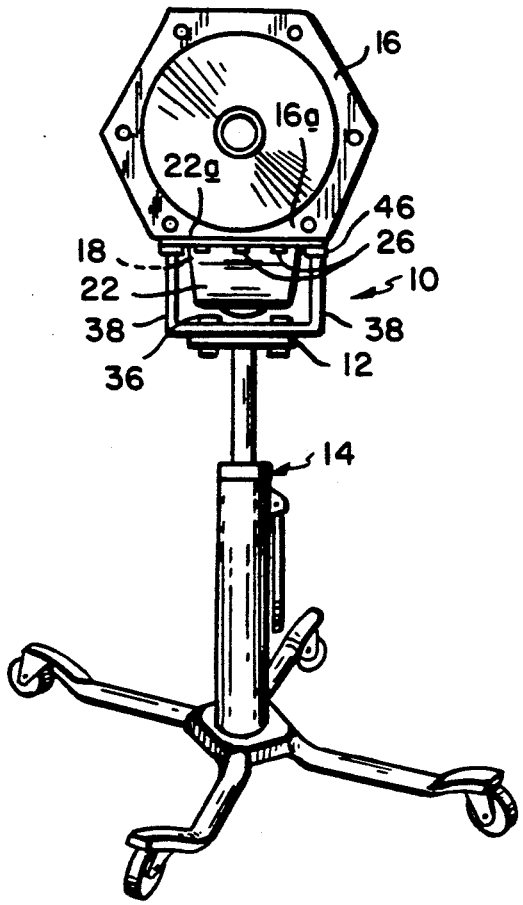
FIG. 1 is an elevational view of a lift jack supporting an automotive transmission by way of a lift jack adaptor incorporating my invention.

Referring now to drawing FIG. 1, my adaptor, shown generally at 10, is designed to be mounted to the lifting platform 12 of a conventional lift jack 14 of the type normally used to support and transport transmissions. An example of this type of jack is the model JST74 Underhoist Transmission Jack shown and described on page 372 in 1990 Products Catalog of MAC Tools, Inc. of Washington Court House, Ohio.

Adaptor 10 is shown as supporting a newer type of transmission 16 that has an opening 18 at the underside of the transmission housing 16*a* which is normally covered or closed by a deeply dished, irregularly shaped pan 22. Pan 22 has a peripheral rim or flange 22*a* formed with a series of spaced apart holes 24 (FIG. 2) which register with corresponding threaded holes (not shown) in the underside of the transmission housing 16*a*. Pan 22 is secured to the transmission housing by bolts 26 inserted through holes 24 and threaded into the holes in the transmission housing, a suitable gasket (not shown) being provided between flange 22*a* and the transmission housing around opening 18 to provide a seal all around the opening.

Figure 2:
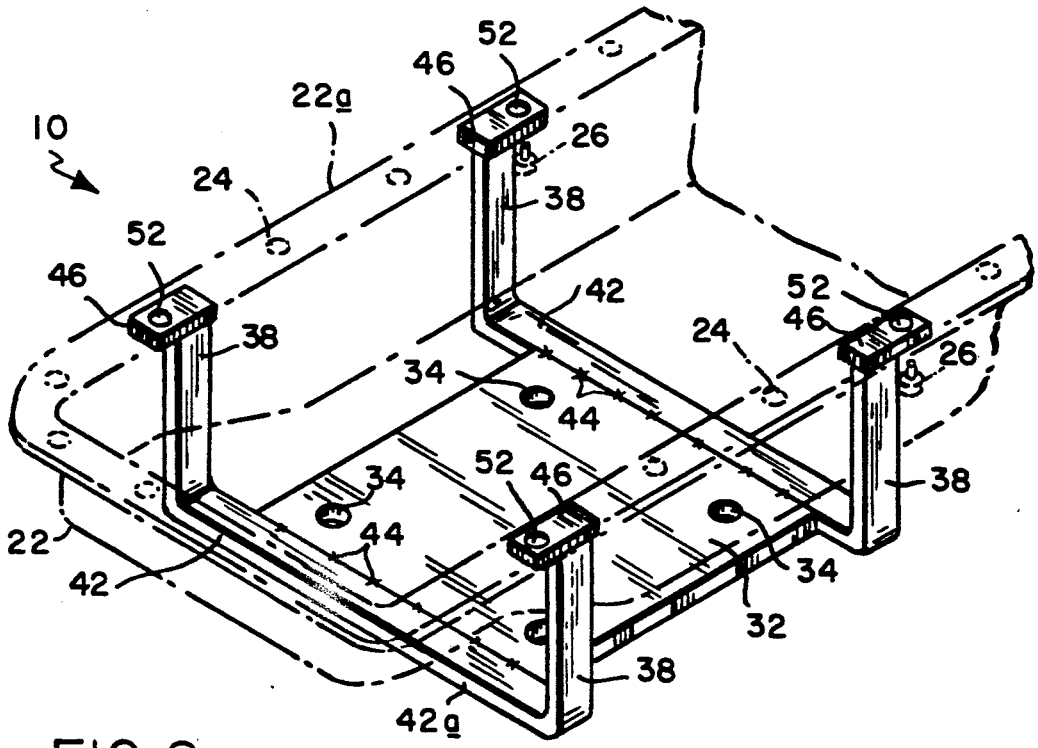
FIG. 2 is an isometric view on a larger scale showing in greater detail the adaptor in FIG. 1.

Referring now to FIG. 2, attachment 10 comprises a generally rectangular rigid metal plate 32 which is in the order of 9.5 inches on a side. The thickness may be 0.25 inch. The plate is formed with a set, herein four, apertures 34 for receiving fasteners 36 (FIG. 1) extending up from the lift platform 12. Fasteners 36 may, for example, be extended versions of the bolts used to secure the adjustable corner brackets present on the lift platform of the jack specifically identified above.

Pairs of arms 38 extend up vertically from plate 32 adjacent to the corners at the front and rear ends of the plate. In the illustrated adaptor 10, the arms 38 are formed by a pair of generally U-shaped straps 42 whose bridging portions 42*a* are connected by weldments 44 to the opposite ends of plate 32. In the adaptor specifically illustrated in FIG. 2, the bridging portion 42*a* of each strap is somewhat wider than plate 32, e.g. 13.5 inches, and each strap is bent so that the arms 38 are in the order of 5.5 inches long. The straps may be formed of the same stock as plate 32 so that the arms 38 are quite rigid.

Still referring to FIG. 2, the upper ends of arms 38 are terminated by generally rectangular flanges 46. These flanges may be integral extensions of the arms 38. More preferably, however, they are welded at their longitudinal centerlines to the upper ends of the arms so that the flanges at each side of plate 32 are collinear and so that the upper surfaces of the flanges in toto define a single plane which is spaced appreciably above, and is more or less parallel to, that plate. In a typical adaptor, for example, each flange 46 may be in the order of 2 inches long and 1.75 inches wide.

Each flange 46 is formed with an aperture 52 situated more or less on the flange centerline about ¾ inch from the outboard end of that flange. In other words, apertures 52 are located in the segments of flanges 46 which extend beyond the corresponding arms 38 at the opposite ends of plate 32 so that those apertures are readily accessible from below.

In order to use adaptor 10, the adaptor's plate 32 is secured to the lifting platform 12 of jack 14 by bolts 36 or comparable fastening means. Then, jack 14 is moved to position adaptor 10 under transmission 16 so that the adaptor brackets the transmission pan 22 as shown in FIG. 2. Next, lifting platform 12 is raised until the adaptor flanges 46 engage the rim 22*a* of the transmission pan 22 from below. Preferably prior to this, appropriate bolts 26 that secure the transmission pan 22 to the transmission housing 16*a* are removed so that the flange apertures 52 can be registered to the holes 24 from which those bolts were removed. If desired, the apertures 52 may be oversized or elongated or formed as slots to make it easier to align them with the bolt holes in pan rim 22*a*. Once the adaptor 10 has been lifted to engage the flanges 46 under the pan rim 22*a*, the bolts 26 may be replaced so that the adaptor is firmly fastened to the underside of the transmission housing 16*a* at the edge margin of opening 18 which, of course, is much stronger than the dished portion of pan 22.

At this point, the transmission 16 can be disconnected from the associated vehicle so that the full weight of the transmission is borne by adaptor 10 and jack 14. Using jack 14, the transmission can now be lowered and wheeled away to another location out from under the vehicle.

Figure 3:
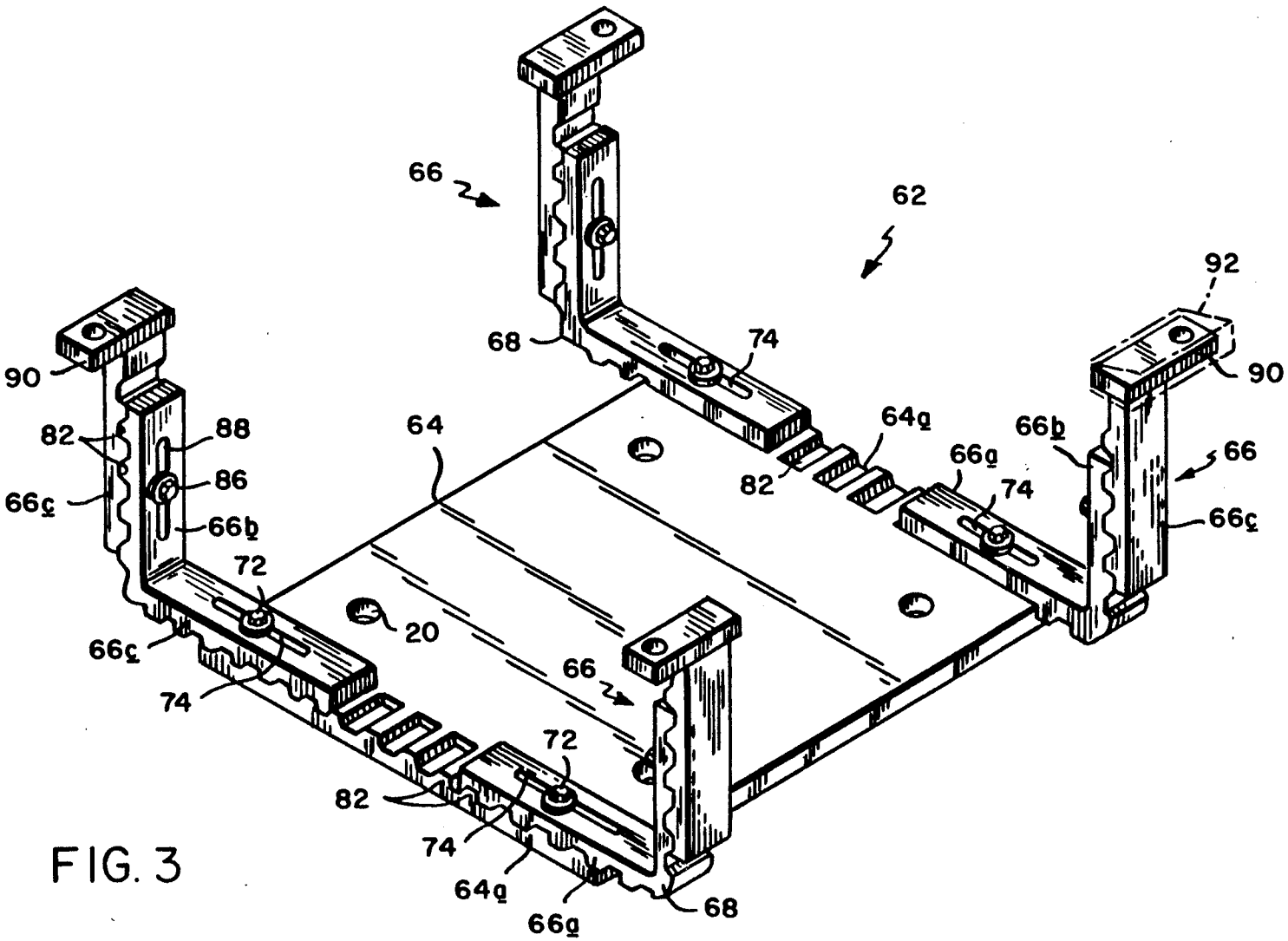
FIG. 3 is a similar view showing a second adaptor embodiment.
Figure 4:
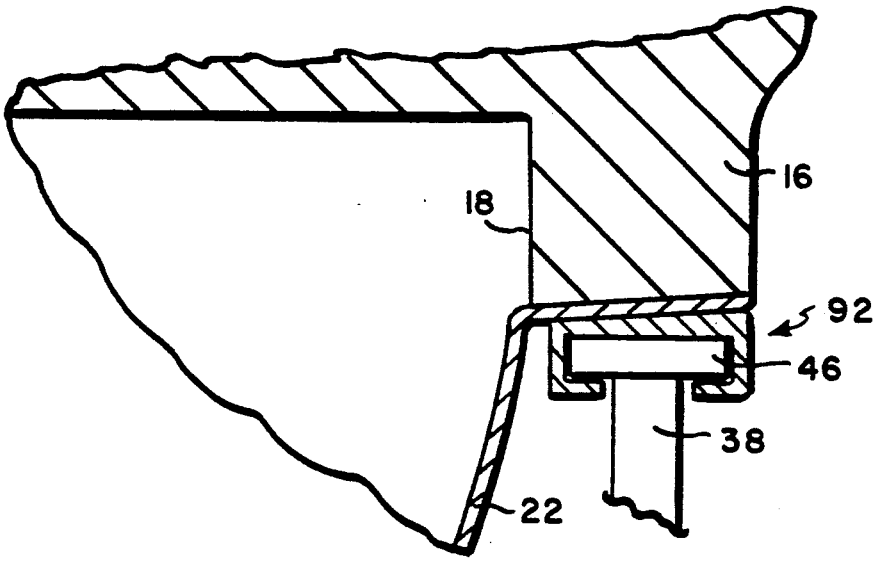

Adaptor 10 shown in FIGS. 1 and 2 is dimensioned and arranged to support a specific size transmission. FIG. 3 shows an adaptor 62 which can be fitted to transmissions having different sizes and shapes. Adaptor 62 includes a rigid plate 64 which supports pairs of upstanding arms shown generally at 66 at opposite ends of plate 64. Here, however, the arms 66 of each pair that are on opposite sides of the plate are movable toward and away from one another. More particularly, the arms 66 of each pair of arms comprise L-shaped straps 68 whose others arms **66*a* are movably mounted to plate 64 by threaded fasteners 72 which extend through longitudinal slots 74 in arms 68 and through threaded holes (not shown) present in the front and rear edge margins 64*a* of the plate. Preferably, the upper faces of those edge margins 64*a* are formed with serrations 82 which are arranged to interfit with similar serrations at the undersides of the arms 66*a* so that when the fasteners 72 are tightened, the lateral spacings of the arms 66** of each pair of arms are fixed.

As the spacing of the arms 66 at opposite sides of plate 64 can be adjustable, so the arms 66 themselves can have adjustable lengths so that the adaptor can be accommodated to transmissions whose pans 22 have different depths. This simply involves making each arm 66 as a telescoping or extensible member. Thus, FIG. 3 shows each vertical arm 66 as comprising a pair of sections **66*b* and 66*c* slidably connected together by means of a threaded fastener 86 which extends through a vertical slot 88 in arm section 66*b* and is threaded into a hole (not shown) in arm 66*b*. Once the combined length of sections 66*b* and 66*c* has been selected, that length may be fixed by tightening fastener 86. Serrations similar to serrations 82 may be provided on the opposing faces of the arm sections 66*b* and 66*c*. In this adaptor version, flanges 90 are welded to the upper ends of arm sections 66*c***.

In order to better match the adaptor to transmissions whose pans have different rim widths and/or orientations, shims or inserts may be seated on the flanges 46 or 90 prior to bolting those flanges to the underside of the transmission housing. One such shim or insert in the form of a sleeve 92 is shown in phantom on the flange 90 of the righthand arm 66 in FIG. 3.

While the invention is described specifically in connection with automotive transmission replacement, it is obvious that adaptors 10 and 62 may be used to support or cradle other heavy, irregular objects.

It will thus be seen that the objects set forth above, among those made apparent from the preceding description, are efficiently attained and, since certain changes may be made in the above constructions without departing from the scope of the invention, it is intended that all matter contained in the above description or shown in the accompanying drawings, shall be interpreted as illustrative and not in a limiting sense.

It will also be understood that the following claims are intended all of the generic and specific features of the invention herein described.

I claim:

1. A lift jack adaptor for cradling an automotive transmission to be lifted having a housing with a bottom opening closed by a deeply dished drop pan with a peripheral flange secured to the edge margin of the opening by bolts threaded into bolt holes in said opening edge margin, said adaptor comprising a rigid rectangular horizontal base having a length and a width;

means for releasably mounting the base to a lift jack for lifting the transmission;

two pairs of elongated vertical arms of substantially equal length, each arm having corresponding first and second ends;

means for connecting the first ends of the arms of each arm pair to the base so that the arms of each arm pair are spaced apart along the width of the base and the pairs of arms are spaced apart along the length of the base, said spacings being such that said arms bracket the transmission pan;

generally rectangular flanges at the second ends of said arms for supporting the transmission housing at said opening edge margin, said flanges defining a single horizontal plane spaced above the base a distance greater then the depth of the transmission pan, and bolt apertures extending through said flanges, each of said apertures registering with a bolt hole in the transmission housing so that the flanges can be bolted to the transmission housing with the same bolts that secure the pan to the housing.

2. The adapter defined in claim 1 wherein the apertures in the flanges of each arm pair are spaced further apart than those arms and are elongated toward the other pair of arms.

3. The adapter defined in claim 1 and further including a separate sleeve slidably engaged over each flange, each sleeve having an upper surface which faces said opening edge margin for adjusting the widths and/or inclinations of the adaptor surfaces engaging the transmission.

4. The adaptor defined in claim 1 wherein the base comprises a flat plate, and the mounting means comprise a set of apertures extending through the plate.

5. The adaptor defined in claim 1 wherein each pair of arms comprises the arms of a generally U-shaped strap having a bridging portion extending between its said arms, and the connecting means comprise weldments between the strap bridging portion and the base.

6. The adaptor defined in claim 5 wherein the strap bridging portion is wider than said base.

7. The adaptor defined in claim 1 wherein the connecting means adjustably connect the first ends of the arms of each arm pair to the base to permit adjustment of the spacing of those arms.

8. The adaptor defined in claim 7 wherein each pair of vertical arms comprises the arms of opposing L-shaped straps having horizontal arms which extend toward one another on the base, and the connecting means comprise, respectively, registering openings in each of said horizontal arms and said base, and fastening means extending through said registering openings.

9. The adaptor defined in claim 8 herein at least one of said registering openings at the connection of each said horizontal arms to the base is elongated in the direction of that arm.

10. The adaptor defined in claim 8 and further including serrations on the opposing surfaces of said horizontal strap arms and said base.

11. The adaptor defined in claim 1 wherein each said arm comprises telescoping sections, and means for fixing the relative positions of said sections so that each said arm is adjustable in length.

* * * * *